US006983513B2

(12) United States Patent
Pettit

(10) Patent No.: US 6,983,513 B2
(45) Date of Patent: Jan. 10, 2006

(54) SPRING BALANCE ASSEMBLY

(75) Inventor: Dean Pettit, St. John, IN (US)

(73) Assignee: Newell Operating Company, Freeport, IL (US)

( * ) Notice: Subject to any disclaimer, the term of this patent is extended or adjusted under 35 U.S.C. 154(b) by 51 days.

(21) Appl. No.: 10/370,084

(22) Filed: Feb. 20, 2003

(65) Prior Publication Data

US 2004/0163209 A1 Aug. 26, 2004

(51) Int. Cl.
*E05F 1/00* (2006.01)

(52) U.S. Cl. ..... 16/197; 49/181

(58) Field of Classification Search ..... 16/197, 16/196, 193, 198, 202, 205, DIG. 16, 400, 16/401; 49/181, 444–447, 190, 193, 456, 49/457

See application file for complete search history.

(56) References Cited

U.S. PATENT DOCUMENTS

| | | | |
|---|---|---|---|
| 1,226,843 | A | 5/1917 | Arvine |
| 1,965,478 | A | 7/1934 | Smith |
| 2,067,164 | A | 1/1937 | Smith |
| 2,262,990 | A | 11/1941 | Cross et al. |
| 2,609,193 | A | 9/1952 | Foster |
| 2,644,193 | A | 7/1953 | Anderberg |
| 2,684,499 | A | 7/1954 | Lewis |
| 2,817,872 | A | 12/1957 | Foster |
| 3,445,964 | A | 5/1969 | Foster |
| 3,452,480 | A | 7/1969 | Foster |
| 3,478,384 | A | 11/1969 | Skolnik |
| 3,711,995 | A | 1/1973 | Anderson |
| 3,820,193 | A | 6/1974 | Foster |
| 3,869,754 | A | 3/1975 | Foster |
| 3,992,751 | A | 11/1976 | Foster et al. |
| 4,028,849 | A | 6/1977 | Anderson |
| 4,227,345 | A | 10/1980 | Durham, Jr. |
| 4,363,190 | A | 12/1982 | Anderson |
| 4,570,381 | A | 2/1986 | Sterner, Jr. |

(Continued)

*Primary Examiner*—Jack Lavinder
*Assistant Examiner*—Andre L. Jackson
(74) *Attorney, Agent, or Firm*—Wallenstein Wagner & Rockey, Ltd.

(57) ABSTRACT

The present invention provides a balance assembly (10) for use with a sash window assembly (104) slidable within a master frame (110). The balance assembly (10) generally includes a plate (20), at least one coil (40), and a shoe or pivot brake assembly (60). The plate (20) is adapted to be attached to the master frame (110). The spring (40) has a coiled portion (42), an intermediate portion (43), and a free portion (44). The coiled portion (42) of the spring (40) is rotatably supported by a support member (30) extending from the plate (20). The free portion (44) of the spring (40) has a curved configuration with a curved end (46). The pivot brake assembly (60) has at least one slot (76) adapted to receive and retain the free portion (44) of the spring (40). The slot (76) defines a protrusion (83) that engages the free portion (44).

23 Claims, 7 Drawing Sheets

U.S. PATENT DOCUMENTS

| | | | | | |
|---|---|---|---|---|---|
| 4,594,813 | A | | 6/1986 | Sterner, Jr. | |
| 4,683,676 | A | | 8/1987 | Sterner, Jr. | |
| 4,694,552 | A | | 9/1987 | Ecker et al. | |
| 4,935,987 | A | | 6/1990 | Sterner, Jr. | |
| 4,953,258 | A | * | 9/1990 | Mennuto | 16/197 |
| 4,958,462 | A | | 9/1990 | Cross | |
| 4,961,247 | A | * | 10/1990 | Leitzel et al. | 16/197 |
| 5,119,591 | A | | 6/1992 | Sterner, Jr. et al. | |
| 5,140,769 | A | | 8/1992 | Hickson et al. | |
| 5,152,032 | A | | 10/1992 | Davis et al. | |
| 5,157,808 | A | * | 10/1992 | Sterner, Jr. | 16/197 |
| 5,189,838 | A | * | 3/1993 | Westfall | 49/181 |
| 5,206,973 | A | * | 5/1993 | Belcher | 16/197 |
| 5,210,976 | A | * | 5/1993 | Cripps | 49/181 |
| 5,232,208 | A | * | 8/1993 | Braid et al. | 267/156 |
| 5,251,401 | A | | 10/1993 | Prete et al. | |
| 5,353,548 | A | | 10/1994 | Westfall | |
| 5,365,638 | A | | 11/1994 | Braid et al. | |
| 5,371,971 | A | | 12/1994 | Prete | |
| 5,377,384 | A | | 1/1995 | Riegelman | |
| 5,463,793 | A | | 11/1995 | Westfall | |
| 5,632,117 | A | | 5/1997 | Prete et al. | |
| 5,661,927 | A | | 9/1997 | Polowinczak et al. | |
| 5,806,243 | A | | 9/1998 | Prete et al. | |
| 5,924,243 | A | | 7/1999 | Polowinczak et al. | |
| 6,041,475 | A | * | 3/2000 | Nidelkoff | 16/193 |
| 6,108,976 | A | * | 8/2000 | Kato et al. | 49/360 |
| 6,115,884 | A | * | 9/2000 | DeJong et al. | 16/197 |
| 6,119,398 | A | | 9/2000 | Yates, Jr. | |
| 6,148,562 | A | * | 11/2000 | Stark et al. | 49/429 |
| 6,183,024 | B1 | | 2/2001 | Schultz et al. | |
| 6,378,169 | B1 | * | 4/2002 | Batten et al. | 16/197 |
| 6,393,661 | B1 | * | 5/2002 | Braid et al. | 16/197 |
| D462,258 | S | * | 9/2002 | Meunier | D8/400 |
| 6,474,394 | B2 | * | 11/2002 | Kuhar | 160/170 |
| 6,523,307 | B2 | * | 2/2003 | Prete et al. | 49/445 |
| 6,553,620 | B2 | * | 4/2003 | Guillemet et al. | 16/197 |
| 2004/0006845 | A1 | * | 1/2004 | Polowinczak et al. | 16/197 |

* cited by examiner

SPRING BALANCE ASSEMBLY

TECHNICAL FIELD

The present invention relates to a spring balance assembly for a sash window. More specifically, the present invention relates to a spring balance assembly having a coil spring that is secured to a pivot brake assembly without the use of a fastener.

BACKGROUND OF THE INVENTION

Sash windows disposed within a master frame are quite common. Generally, the master frame includes a pair of opposed vertical guide rails, an upper horizontal member or header, and a lower horizontal member or base. The guide rails are designed to slidingly guide at least one sash window within the master frame. Double hung sash windows have an upper sash window and a lower sash window. The guide rails of the master frame define an elongated channel. To counterbalance the sash window during movement of the window, a spring balance assembly is affixed to the master frame in the elongated channel and connected to the sash window.

One conventional balance assembly includes a plate, one or more coil springs, and a pivot brake assembly or brake shoe. The plate rotatably supports both coil springs. Each spring has a coiled portion and a free portion. Typically, the free portions of the springs are linear and include an aperture. The pivot brake assembly includes a housing having at least one aperture adapted to receive a fastener. When the conventional spring brake assembly is in the assembled position, the springs are secured to the pivot brake assembly by the fastener. Thus, the free portions of the springs are attached to the housing of the pivot brake assembly by a fastener passing through the aperture in the free portion of the springs and into the aperture of the housing.

Conventional balance assemblies exhibit limitations due to the manner in which the coil springs are connected to the pivot brake assembly. The use of a fastener, including a threaded fastener, requires additional labor and time during assembly of the spring balance. Furthermore, the fastener represents an additional part that increases material costs. In addition, use of the fastener necessitates the extra manufacturing step of forming the aperture in the free portion of the coil spring as well as the corresponding apertures in the housing.

Therefore, there is a tangible need for a spring balance assembly that does not require a fastener to secure the coil spring to the pivot brake assembly, thereby decreasing assembly time and material costs.

The present invention is provided to solve these and other deficiencies.

SUMMARY OF THE INVENTION

The present invention relates to a balance assembly for use with a sash window assembly. According to a first aspect of the invention, the balance assembly comprises a plate, a coil spring and a shoe or pivot brake assembly. The coil spring has a coiled portion, an intermediate portion, and a curvilinear free portion. The shoe includes at least one slot with a curved segment that receives the curvilinear free portion of the spring. The plate has a support member that extends from the plate and rotatably supports the coil spring without binding or inhibiting the rotation of the spring. The plate has at least one opening that is adapted to receive a fastener to secure the plate to a master frame of the sash window assembly. Preferably, the opening passes through an extent of the support member. The balance assembly can have a first spring and a second spring wherein the free portion of each spring has a curvilinear configuration with a curved or rolled free end. The free portion of each spring is received by the slots of the pivot brake assembly.

According to another aspect of the invention, the pivot brake assembly is operably connected to a lower portion of the sash window. When the pivot brake assembly is coupled to the sash window the balance assembly counterbalances the weight of the sash window wherein the first and second springs exert a generally upward force on the sash window. The pivot brake assembly comprises a housing, a cam, and a brake pad. The housing includes a front wall, a rear wall, a bottom wall, and two sidewalls. The housing has a chamber passing through the front wall and rear wall of the housing. The chamber is adapted to receive the cam. The housing further includes a pair of openings adapted to receive and retain the brake pad. The housing further has a central cavity defined generally between the first and second sidewalls and opposite the bottom wall.

According to another aspect of the invention, the housing of the pivot brake assembly has two slots. Alternatively, the pivot brake assembly includes a single slot. Each slot is positioned between one of the sidewalls and the central cavity. Each slot has a first end terminating within the housing and a generally opposing second end proximate the sidewall. The slots each have a curved portion between the first end and the second end. Preferably, the curved portion is in communication with the first end of the slot. The curved portion of each slot defines a first protrusion. Each slot is adapted to receive at least a portion of the free portion of either or both of the coil springs. Consequently, the slots are cooperatively dimensioned with the free portions of the coil springs.

According to yet another aspect of the invention, when the balance assembly of the present invention is in the assembled position, the first spring is secured to the pivot brake assembly by engagement between the free portion of the first spring and the curved portion of the first slot. Similarly, the second spring is secured to the pivot brake assembly by engagement between the free portion of the second spring and the curved portion of the first slot. Specifically, during assembly, the free portions of both springs are inserted into the first slot through the rear wall of the housing such that at least a portion of the free portions engage the curved portion of the first slot. Thus, both springs are secured to the pivot brake assembly without the use of any fasteners. Although both springs may be installed in the same slot, it is also understood that other configurations are possible without departing from the spirit of the present invention. For example, both free portions can be installed in either the first slot or the second slot Alternatively, the free portion of the first spring can be installed in the first slot, while the free portion of the second spring can be installed in the second slot. Similarly, the free portion of the first spring can be installed in the second slot, while the free portion of the second spring can be installed in the first slot. The various configurations of the free portions with the slots will be obvious to one of ordinary skill in the art.

The spring balance assembly of the present invention provides a number of significant advantages over conventional balance assemblies. Due to the configuration of the slots and the free portions, the springs are engaged by the pivot brake assembly without the use of any fasteners. As a result, assembly and disassembly of the spring balance assembly can be accomplished significantly faster. Thus, manufacturing times of the window assembly can be reduced since engagement of the springs to the pivot brake assembly involves only sliding the cooperatively dimensioned free portions into the appropriate slot. Consequently, the spring balance assembly of the present invention offers a multitude of cost-savings benefits as well as increased versatility, adjustability, and ease of assembly.

Other features and advantages of the invention will be apparent from the following specification taken in conjunction with the following drawings.

DETAILED DESCRIPTION OF THE INVENTION

Figure 1:
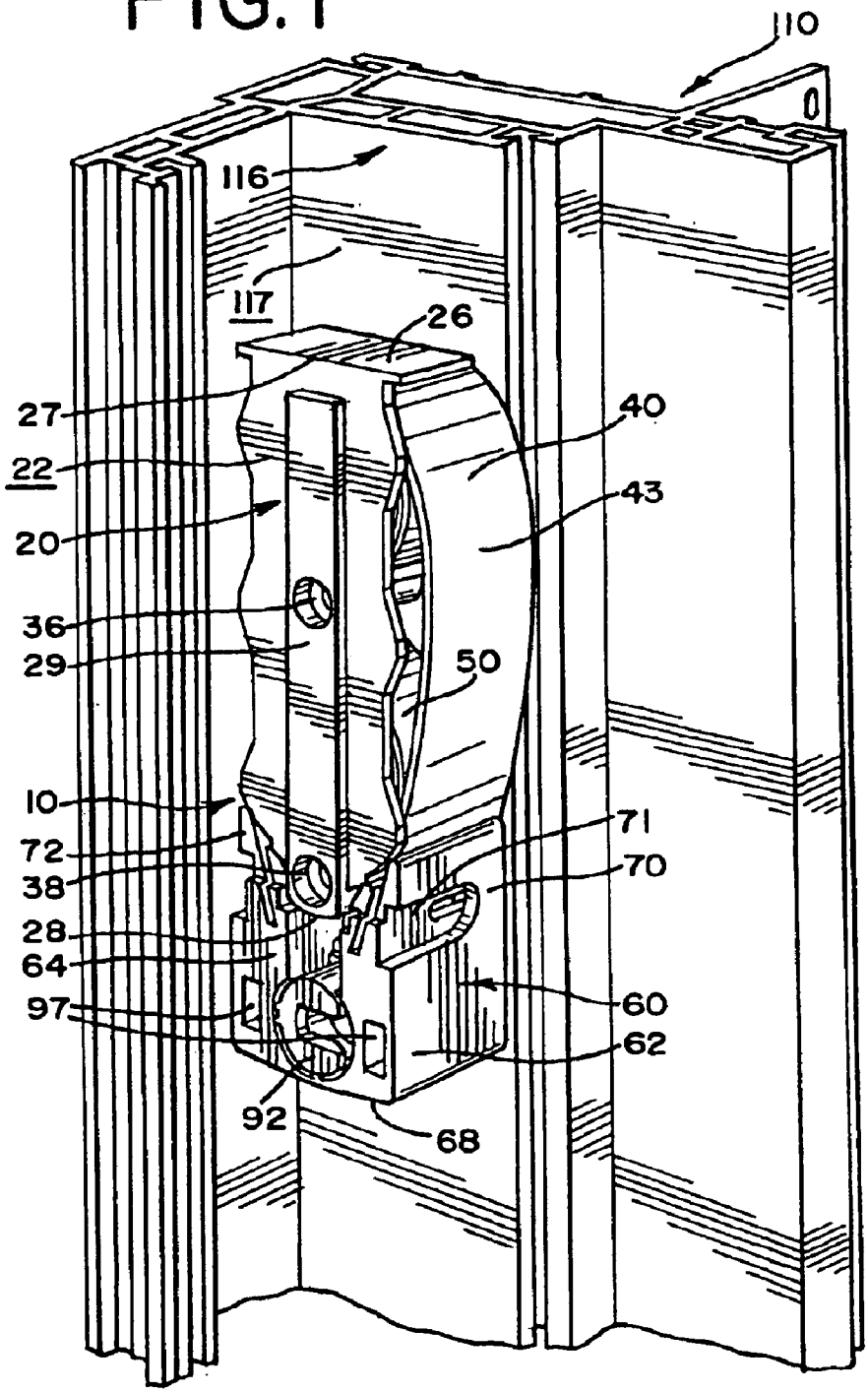
FIG. 1 is a perspective view of a spring balance assembly of the present invention, showing the spring balance assembly connected to a partial master frame.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 11B:
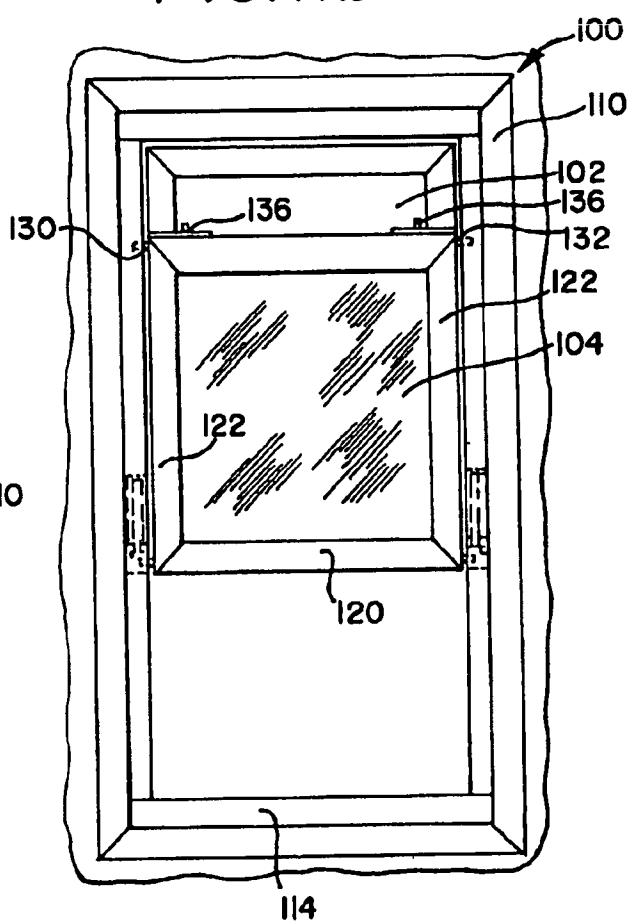
FIG. 11B is a front elevation view of the spring balance assembly mounted to a sash window assembly wherein the window assembly is shown in an open position.
Figure 11A:
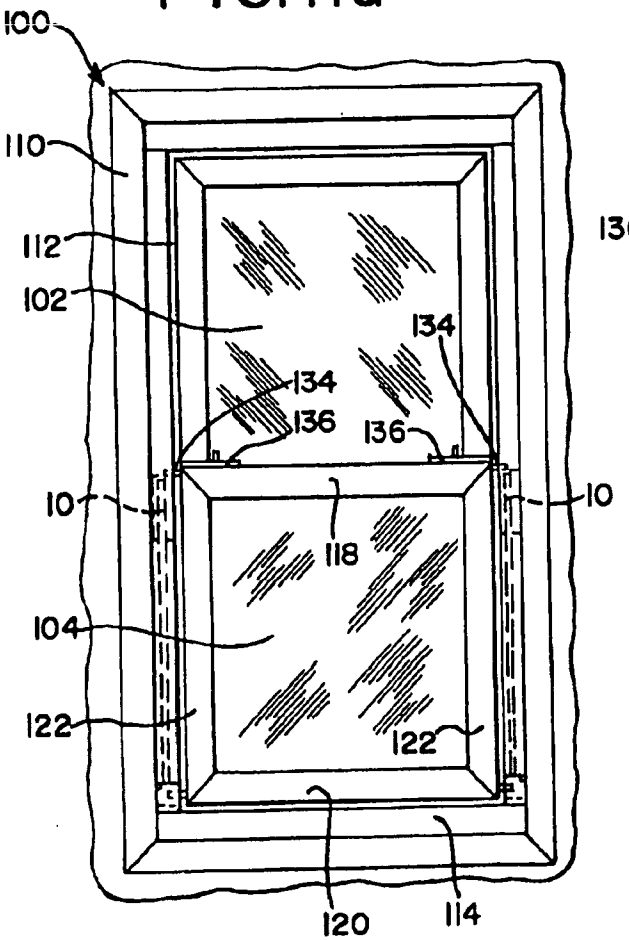
FIG. 11A is a front elevation view of the spring balance assembly mounted to a sash window assembly wherein the window assembly is shown in a closed position.

Referring to FIGS. 1, 11A, and 11B, a balance assembly 10 is affixed to a sash window assembly 100. The sash window assembly 100 shown in FIG. 11 is a double-hung window assembly having an upper pivotal sash window 102 and a lower pivotal sash window 104 in a master frame 110. In general terms, the master frame 110 includes a pair of opposed vertical guide rails 112 adapted to slidably guide the sash windows 102, 104. The master frame further includes a footer or lower horizontal element 114. The guide rail 112 defines an elongated channel 116 in which the spring balance assembly 10 is mounted. Typically, the master frame 110 has a set of guide rails 112 for each sash window 102,104 and the balance assembly 10 is mounted to each guide rail 112 to balance the sash window 102, 104.

The sash window 104 has a top rail 118, a base rail 120, and a pair of stiles or side rails 122. A tilt latch 130 is mounted in an upper portion of the top rail 118. The tilt latch 130 has a bolt 132 with a nose portion 134 adapted to extend into the elongated channel 116. The tilt latch 130 has an actuator 136 and a spring (not shown) wherein the actuator 136 is designed to retract the bolt 132 into the housing of the latch 130 against the biasing force of the spring.

As shown in FIGS. 1–5, the balance assembly 10 generally includes a plate 20, a first coil spring 40, a second coil spring 50, and a shoe or pivot brake assembly 60.

In general terms, the plate 20 rotatably supports the first coil spring 40 and the second coil spring 50, while each are coupled to the pivot brake assembly 60. The plate 20 has an outer surface 22, an inner surface 24, and a top wall 26. The plate 20 further has an upper edge 27 and a lower edge 28. The outer surface 22 of the plate 20 extends between the upper edge 27 and the lower edge 28, and faces towards the sash window 104 when the balance assembly 10 is mounted to the guide rail 112 of the master frame 110. The inner surface 24 of the plate 20 extends between the upper edge 27 and the lower edge 28, and faces towards the channel 116 when the balance assembly 10 is mounted to the guide rail 112 of the master frame 110. The top wall 26 extends from the upper edge 27 of the plate 20 and towards an inner surface 117 of the channel 116. The outer surface 22 of the plate 20 has a raised strip 29 which extends along the outer surface 22 between the upper edge 27 and the lower edge 28. The raised strip 29 is adapted to increase the structural rigidity of the plate 20 and balance assembly 10. The strip 29 can include indicia that reflects the size and/or rating of the coil springs 40, 50. The plate 20 has a length, thickness, and width which can be varied depending upon the design parameters of the balance assembly 10.

Figure 2:
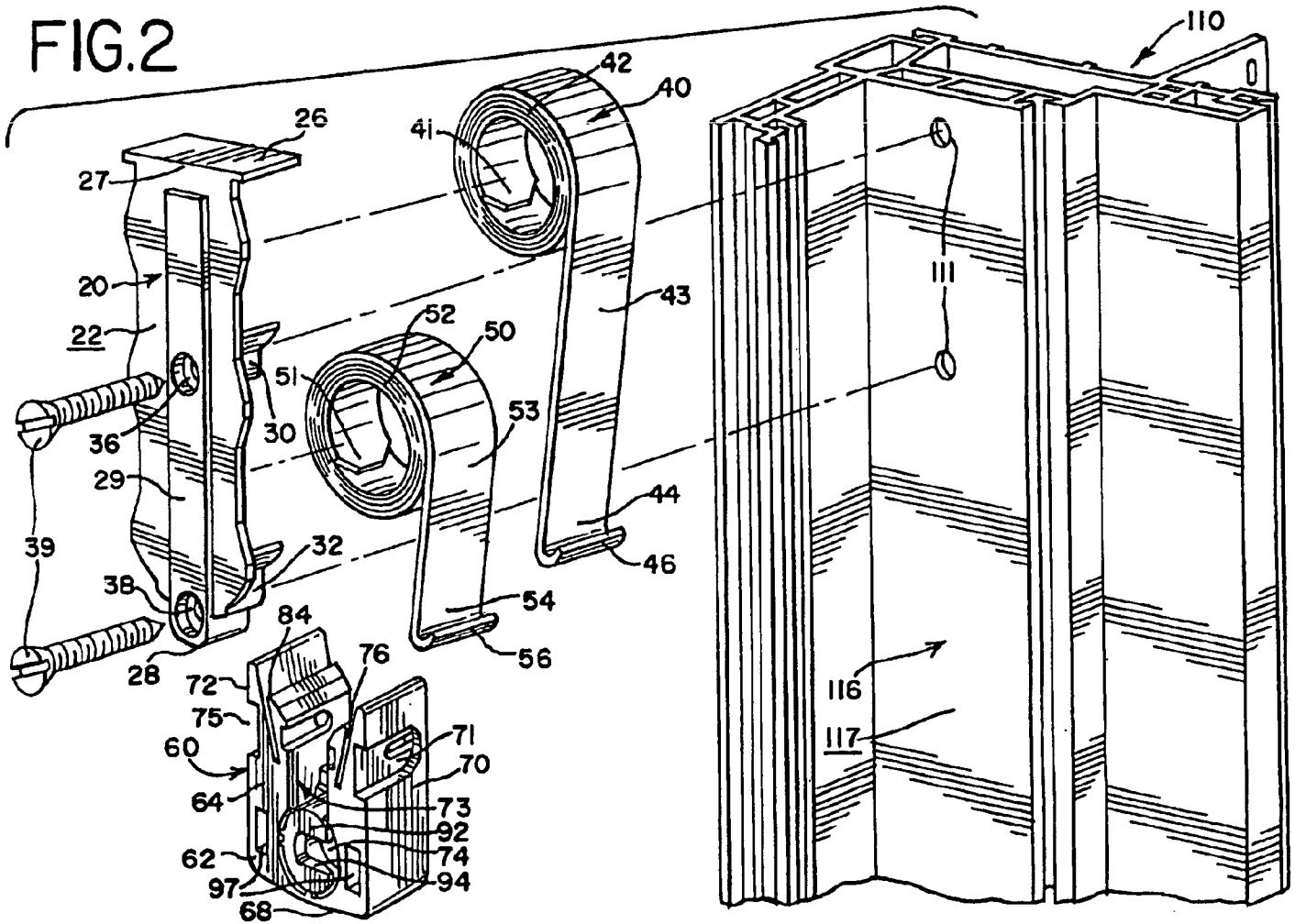
FIG. 2 is an exploded view of the spring balance assembly of FIG. 1.
Figure 4:
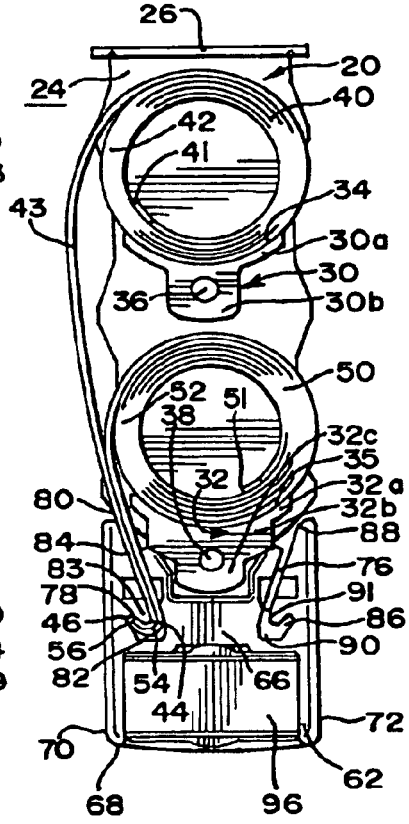
FIG. 4 is a rear elevation of the spring balance assembly of FIG. 1.

The inner surface 24 of the plate 20 has a first support member 30 and a second support member 32 wherein each member 30,32 extends generally perpendicular from the inner surface 24. Thus, the support members 30, 32 extend towards the inner surface 117 of the channel 116 when the balance assembly 10 is installed. Preferably, the first member 30 is substantially parallel to the second member 32, and the members 30, 32 are of generally equal length. The second member 32 extends from the inner surface 24 proximate the lower edge 28 of the plate. The first member 30 extends from the inner surface between the upper edge 27 and the lower edge 28 of the plate 20. Each support member 30, 32 rotatably supports one of the coil springs 40, 50 of the balance assembly 10; however, neither support member 30, 32 binds or inhibits the rotation of the springs 40, 50. The first support member 30 has an upper portion 30*a* and a base portion 30*b*. The upper portion 30*a* of the support member 30 has a curvilinear configuration that defines a concave supporting surface 34 (see FIG. 4). The concave support surface 34 of the first member 30 is adapted to contact and rotatably engage the first coil spring 40. The second support member 32 has an upper portion 32*a*, an intermediate portion 32*b*, and a base portion 32*c* which provide the second support member 32 with a stepped or notched appearance. As shown in FIG. 2, the base portion 32*c* extends beyond the lower edge 28 of the plate 20. The upper portion 32*a* of the support member 32 has a curvilinear configuration that defines a concave supporting surface 35. Like the support surface 34 of the first member 30, the support surface 35 of the second member 32 is adapted to contact and rotatably support the second coil spring 50. As shown in FIG. 4, the first and second support members 30, 32 are positioned such that each rotatably engages an outer surface of the springs 40, 50. Described in a different manner, the first and second support members 30, 32 are not located within the internal region or spool of the coil springs 40, 50. As a result, the first support member 40 and the second support member 50 are positioned beyond the circumference of the coil springs 40, 50. Preferably, the upper portions 30*a*, 32*a* (and the resulting support surfaces 34, 35) have a curvilinear configuration to provide increased support to the springs 40, 50. However, it is understood that the shape of each of the members 30, 32, including the upper portions 30*a*, 32*a* can assume different configurations so long as the members 30, 32 rotatably support the two springs 40, 50.

In addition, the plate 20 has two openings 36, 38 which are each adapted to receive a fastener 39. As shown in FIGS. 2 and 4, the openings 36, 38 pass through an extent of the support members 30,32. Preferably, the first opening 36 passes through the base portion 30*a* of the first member 30 and the second opening 38 passes through an extent of the intermediate and base portions 32*b*, 32*c* of the second member 32. However, it is understood that the openings 36,38 can be located elsewhere on the plate 20 without departing from the spirit of the present invention. Thus, the locations of the openings 36, 38 can be varied depending upon the design parameters of the balance assembly 10. Similarly, the plate 20 can feature only one opening 36. A fastener 39 is inserted into one or both of the openings 36, 38 to secure the plate 20 of the balance assembly 10 to the master frame 110 within in the channel 116. An extent of the fastener 39 is received by an aperture 111 in the master frame 110. Note that the guide rail 112 has been omitted from the master frame 110 in FIGS. 1 and 2 for illustrative purposes. The fastener 39 can be a screw, rivet, or any elongated structure capable of securing the balance assembly 10 to the master frame 110.

Referring to FIGS. 2 and 4, the first spring 40 has a terminal end 41, a coiled portion 42, an intermediate portion 43, and a free portion 44. The coiled portion 42 of the first spring 40 forms a spool which is rotatably supported by the first support member 30. The terminal end 41 of first spring 40 is located within the spool formed by the coiled portion 42 of the first spring 42. The free portion 44 of the first spring 40 has a curvilinear configuration with a curved or rolled free end 46. The free portion 44 partially engages a portion of the pivot brake assembly 60. Similarly, the second spring 50 has a terminal end 51, a coiled portion 52, an intermediate portion 53, and a free portion 54. The coiled portion 52 of the second spring 50 forms a spool which is rotatably supported by the second support member 32. The terminal end 51 of the second spring 50 is located within the spool formed by the coiled portion 52 of the second spring 50. The free portion 54 of the second spring 50 has a curvilinear configuration with a curved or rolled free end 56. As detailed below, the free portion 54 partially engages a portion of the pivot brake assembly 60. When viewed in cross-section, the free portions 44, 54 have a "J-shaped" configuration that defines a tab. It is understood that the free portions 44, 54 can have other curvilinear or angular configurations, such as "L-shaped." It is further understood that balance assembly 10 can include only the first spring 40 without comprising the operation of the balance assembly 10.

The shoe or pivot brake assembly 60 is operably connected to both the first and second springs 40, 50. In addition, the pivot brake assembly 60 is operably connected to a lower portion of the sash window 104 near the base rail 120. When the pivot brake assembly 60 is coupled to the sash window 104 the balance assembly 10 counterbalances the weight of the sash window 104 wherein the first and second springs 40, 50 exert a generally upward force on the sash window 104 when it is moved between the closed and open positions of FIGS. 11A and 11B. The pivot brake assembly 60 generally includes a housing 62, a cam 92, and a brake pad 96 (see FIG. 4). The housing 62 of the pivot brake assembly 60 receives and supports the cam 92, and the brake pad 96. It is understood that the pivot brake assembly 60 can be a shoe which does not include a brake pad 96 such as for a non-tiltable sash window.

The housing 62 of the pivot brake assembly 60 includes a front wall 64, a rear wall 66, a bottom wall 68, and two sidewalls 70, 72. The front wall 64, rear wall 66, bottom wall 68 and sidewalls 70, 72 cooperate to form the housing 62. As seen in FIG. 2, the housing 62 has a chamber 73 passing through the front wall 64 and rear wall 66 of the housing 62. Preferably the chamber 73 is proximate the bottom wall 68 of the housing 62. The chamber 73 preferably has a generally cylindrical configuration, and is adapted to receive the cam 92. Each of the side walls 70, 72 have a recessed portion 71, 75. The housing further includes a pair of openings 97 adapted to receive and retain the brake pad 96. Each opening 97 passes through the front wall 64 and rear wall 66 of the housing 62. The housing 62 further has a central cavity 74 defined generally between the first and second sidewalls 70, 72, and opposite the bottom wall 68. Thus, the chamber 73 is located between the central cavity 74 and the bottom wall 68.

Preferably, the housing 62 of the pivot brake assembly 60 further includes two slots 76, 84, as shown in FIGS. 2 and 4. Alternatively, the pivot brake assembly 60 includes a single slot 76. The first slot 76 is positioned between the first sidewall 70 and the central cavity 74, while the second slot 84 is positioned between the second sidewall 72 and the central cavity 74. The first slot 76 has a first end 78 terminating within the housing 62, and a generally opposing second end 80, proximate the first sidewall 70. Also, the first slot 76 has a curved portion 82 between the first end 78 and the second end 80. Preferably, the curved portion 82 of the first slot 76 is in communication with the first end 78 of the first slot 76. The curved portion 82 of the slot 76 defines a first protrusion 83. Similarly, the second slot 84 has a first end 86 terminating within the housing 62, and a generally opposing second end 88 proximate the second sidewall 72. The second slot 84 has a curved portion 90 between the first end 86 and the second end 88. Preferably, the curved portion 90 of the second slot 84 is in communication with the first end 86 of the second slot 84. The curved portion 90 of the slot 84 defines a second protrusion 91. In general terms, each slot 76, 84 is adapted to receive at least a portion of the free portion 44, 54 of either or both coil springs 40, 50. Consequently, the slot 76, 84 is cooperatively dimensioned with the free portion 44, 54 of the coil springs 40, 50. Thus, it is understood that the slots are configured to correspond to the configuration of the free portions 44, 54 of the springs 40, 50.

Figure 3:
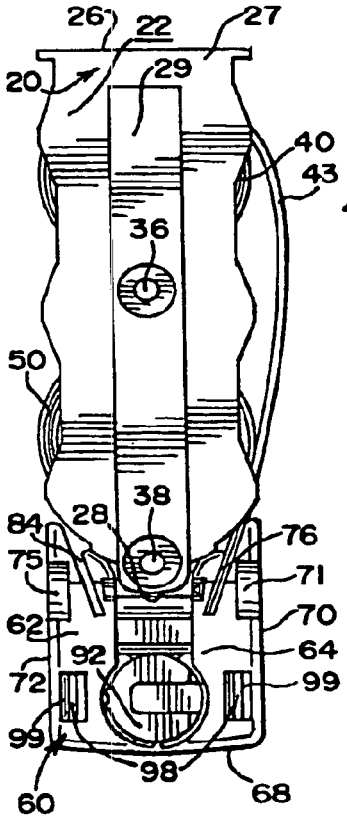
FIG. 3 is a front elevation of the spring balance assembly of FIG. 1.

Additionally, it is preferable that the slots 76, 84 do not pass through the entire housing 62. Thus, as seen in FIG. 4, while both slots 76, 84 are accessible from the rear wall 66, only a portion of the slots 76, 84 are viewable from the front wall 64, as seen in FIG. 3. Described in a different manner, the front wall 64 of the housing 62 covers at least a portion of the slots 76, 84 while the slots 76, 84 are open to the rear wall 66 of the housing. The front wall 64 covering a portion of the slots 76, 84 assists in retaining the free portions 44, 54 of the coil springs 40, 50 when the balance assembly 10 is installed. Alternatively, the front wall 64 does not cover the slots 76, 84 and the slots 76, 84 extend through the housing 62. Consequently, the slots 76, 84 are visible from the front wall 64. Alternatively, the slot 76, 84 is resiliently reclosable whereby there is an interference fit between the slot 76, 84 and the free portion 44, 54. In this manner, there is a "squeezing" of the free portion 44, 54 by the slot 76, 84 to maintain the free portion 44, 54 therein.

The cam 92 is cooperatively dimensioned to be installed in the chamber 73. The cam 92 and chamber 73 are configured so that the cam 92 can pass into the chamber 73 only through the rear wall 66 of the housing 62. Thus, the cam 92 cannot pass into the chamber 73 through the front wall 64 of the housing. Furthermore, the cam 92 and chamber 73 are configured so that the once the cam 92 is installed in the chamber 73, the cam 92 cannot pass out of the front wall 64 of the housing 62. Thus, once installed, the cam 92 can only be removed from the chamber 73 through the rear wall 66 of the housing 62. The cam 92 further includes a receiver 94 in communication with the front wall 64 of the housing 62. The receiver 94 is cooperatively dimensioned to engage a portion of the sash window 104.

The brake pad 96 is adapted to contact and slide along the inner surface 117 of the channel 116 in the master frame 110 providing resistance against uncontrolled sliding of the sash window 104 in the master frame 110. The brake pad 96 includes a pair of fingers 98 extending generally perpendicular therefrom. Each of the fingers 98 is cooperatively dimensioned to be inserted into the openings 97 of the housing 62. The fingers 98 are configured to engage the openings 97 in the housing 62, thereby connecting the brake pad 96 to the housing 62. Furthermore, the fingers 98 are adapted to resist disconnection from the housing 62 once engaged in the openings 97. As discussed above, the brake pad 96 can be omitted thereby causing the pivot brake assembly 60 to referred to as a shoe.

When the balance assembly 10 of the present invention is in the assembled position (see FIGS. 1 and 3–5), the first spring 40 is secured to the pivot brake assembly 60 by engagement between the free portion 44 of the first spring 40 and the curved portion 82 of the first slot 76. Similarly, the second spring is secured to the pivot brake assembly 60 by engagement between the free portion 54 of the second spring 50 and the curved portion 82 of the first slot 76. Specifically, during assembly, the free portions 44, 54 of both springs 40, 50 are inserted into the first slot 76 through the rear wall 66 of the housing 62 such that at least a portion of the free portions 44, 54 engage the protrusion 83. This engagement retains the free portions 44, 54 in the slot 76. Thus, both springs 40, 50 are secured to the pivot brake assembly 60 without the use of any fasteners. Alternatively, the free portion 54 of the second coil spring 50 is inserted into the second slot 84 and engages the second protrusion 91.

In the assembled position, the coiled portion 42 of the first spring 40 engages the support surface 34 of the first member 30 of the plate 20, thereby supporting the coiled portion 42. Similarly, the coiled portion 52 of the second spring 50 engages the support surface 35 of the second member 32 of the plate 20, thereby supporting the coiled portion 52. Thus the springs 40, 50 are supported by the plate 20 in a "stacked" configuration. The plate 20 is attached to master frame 110 of the sash window assembly 100 via fasteners 39 that passes through the openings 36, 38 in the plate 20 and engage corresponding apertures 111 in the master frame 110, such that the springs 40, 50 are located in the channel 116. Thus, the springs 40, 50 are enclosed between the inner surface 24 of the plate 20 and the inner surface 117 of the channel 116. The pivot brake assembly 60 is then attached by engaging the sash window 104 with the receiver 94 of the cam 92.

Figure 5:
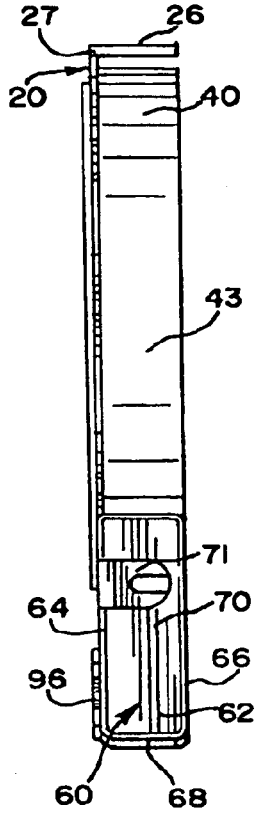
FIG. 5 is a side elevation of the spring balance assembly of FIG. 1.
Figure 6:
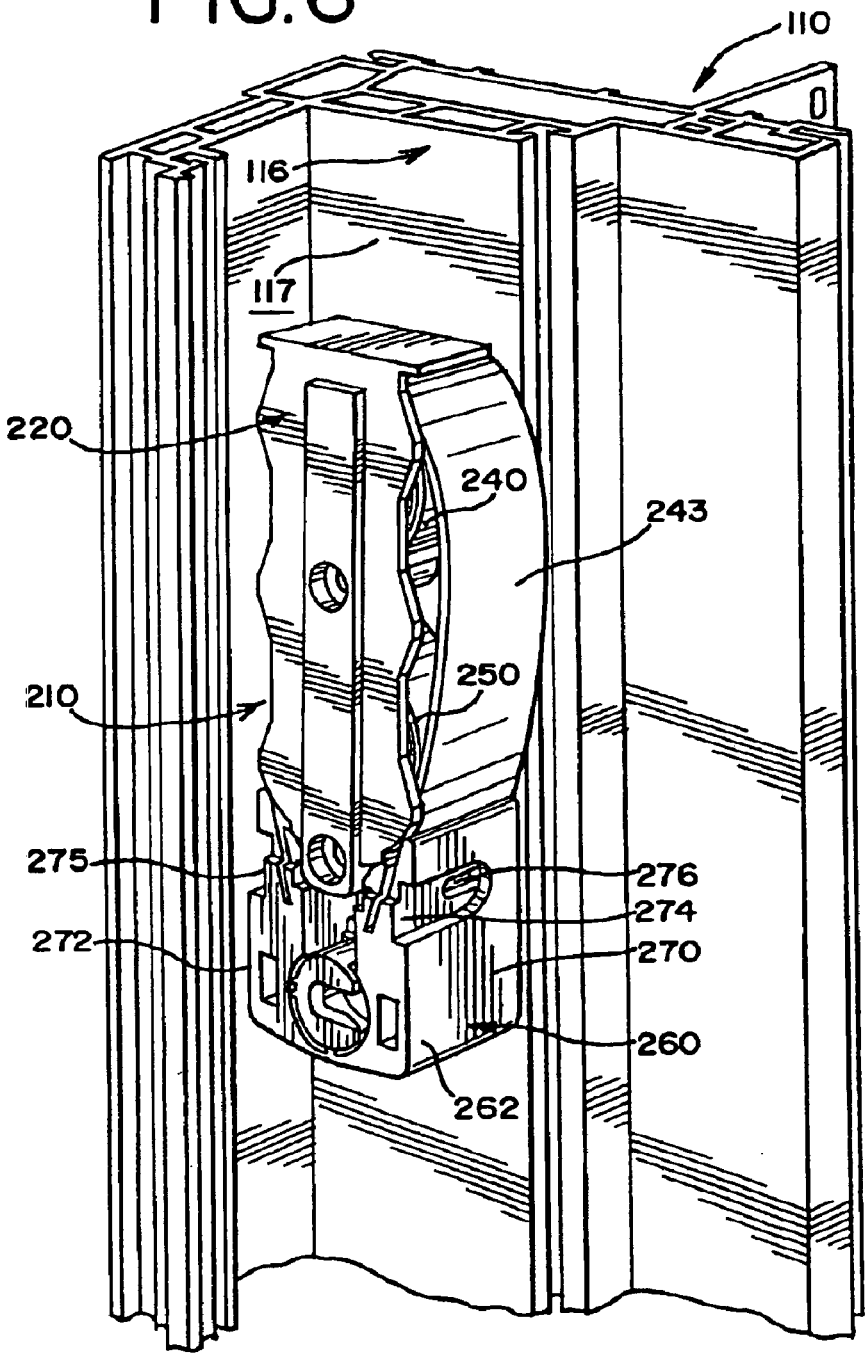
FIG. 6 is a perspective view of a second embodiment of a spring balance assembly of the present invention, showing the spring balance assembly connected to a partial master frame.
Figure 7:
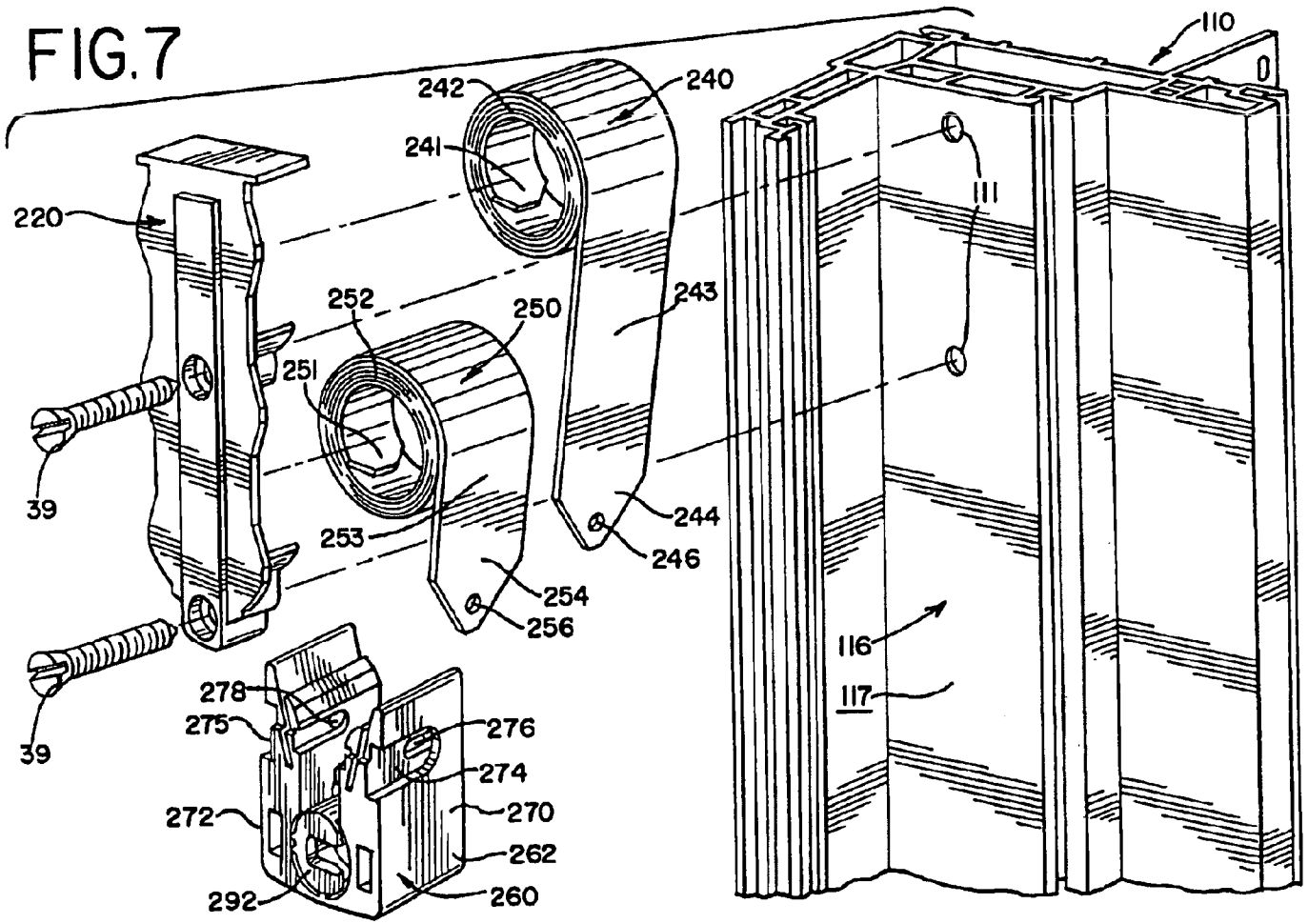
FIG. 7 is an exploded view of the spring balance assembly of FIG. 6.
Figure 8:
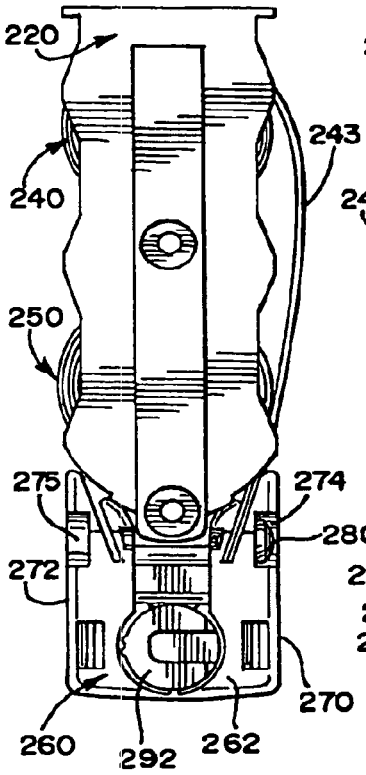
FIG. 8 is a front elevation of the spring balance assembly of FIG. 6.
Figure 9:
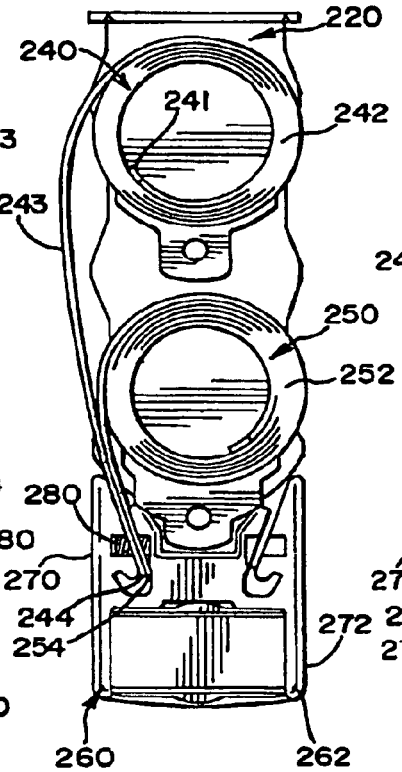
FIG. 9 is a rear elevation of the spring balance assembly of FIG. 6.
Figure 10:
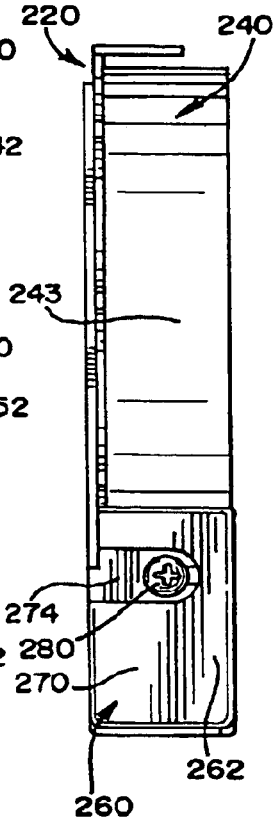
FIG. 10 is a side elevation of the spring balance assembly of FIG. 6.

Although FIGS. 3–5 show the free portions 44, 54 of both springs 40, 50 installed in the same slot 76, it is also understood that other configurations are possible without departing from the spirit of the present invention. For example, the balance assembly 10 may be assembled such that the first spring 40 is secured to the pivot brake assembly 60 by engagement between the free portion 44 of the first spring 40 and the first protrusion 83 of the first slot 76, while the second spring is secured to the pivot brake assembly 60 by engagement between the free portion 54 of the second spring 50 and the second protrusion 91 of the second slot 84. Thus, unlike FIG. 4 where both free portions 44, 54 are installed in the same slot 40, 50, in this embodiment, the free portions 44, 54 are installed in separate slots 40, 50. Specifically, during assembly, the free portion 44, 54 of each spring 40, 50 are inserted into its respective slot 76, 84 through the rear wall 66 of the housing 62 such that at least a portion of the free portion 44, 54 engages the protrusions 83, 91 of the slot 76, 84. A portion of the free portion 44, 54 confronts the curved portion 82, 90 of the slot 76, 84 to retain the free portion 44, 54 in the slot 76, 84. Thus, both springs 40, 50 are secured to the pivot brake assembly 60 without the use of any fasteners. Numerous other configurations exist. For example, both free portions 44, 54 can be installed in either the first slot 76 or the second slot 84. Alternatively, the free portion 44 of the first spring 40 can be installed in the first slot 76, while the free portion 54 of the second spring 50 can be installed in the second slot 84. Similarly, the free portion 44 of the first spring 40 can be installed in the second slot 84, while the free portion 54 of the second spring 50 can be installed in the first slot 76. The various configurations of the free portions 44, 55 with the slots 76, 84 will be obvious to one of ordinary skill in the art.

A second embodiment of a spring brake assembly 210 of the present invention is shown in FIGS. 6–10. As seen therein, the spring brake assembly 210 includes a plate 220, two coil springs 240, 250 and a pivot brake assembly 260. The plate 220 rotatably supports both coil springs 240, 250. Each spring 240, 250 has a terminal end 241, 251, a coiled portion 242, 252, and intermediate portion 243, 253 and a free portion 244, 254. The terminal end 241, 251 of each spring 240, 250 is located within the spool formed by the coiled portion 242, 252. In the second embodiment, the free portions 244,254 of the springs 240,250 have a generally straight configuration, and include an aperture 246, 256. The pivot brake assembly 260 includes a housing 262 having a first sidewall 270 and a second sidewall 272. Each of the sidewalls 270, 272 has a recessed portion 274,275. Each sidewall 270,272 further includes an aperture 276, 278 located in the recessed portion 274, 275. Each aperture 276, 278 is adapted to receive a fastener 280. When the spring brake assembly 210 of the second embodiment is in the assembled position, the springs 240, 250 are secured to the pivot brake assembly 260 by the fasteners 280. Thus, the free portion 244 of the first spring 240 is attached to the housing 262 of the pivot brake assembly 260 by a fastener 280 passing through the aperture 246 in the free portion 244 and into the aperture 276 of the first sidewall 270. Similarly, the free portion 254 of the second spring 250 is attached to the housing 262 of the pivot brake assembly 260 by a fastener 280 passing through the aperture 256 in the free portion 254 and into the aperture 278 of the second sidewall 272. Thus, the pivot brake assembly 260 of the present invention is adapted to receive springs 40, 50 with curved free portions 44, 54 as well as springs with straight free portions 244,254 bearing apertures 276, 278.

When the spring brake assembly 210 of the second embodiment is in the assembled position, the springs 240, 250 are secured to the pivot brake assembly 260 by the fasteners 280. Thus, the free portion 244 of the first spring 240 is attached to the housing 262 of the pivot brake assembly 260 by a fastener 280 passing through the aperture 246 in the free portion 244 and into the aperture 276 of the first sidewall 270. Similarly, the free portion 254 of the second spring 250 is attached to the housing 262 of the pivot brake assembly 260 by a fastener 280 passing through the aperture 256 in the free portion 254 and into the aperture 278 of the second sidewall 272. Thus, the pivot brake assembly 260 of the present invention is adapted to receive springs 40, 50 with curved free portions 44, 54 as well as springs with straight free portions 244, 254 bearing apertures 276, 278.

The balance assembly 10 of the present invention provides a number of significant advantages over conventional balance assemblies. First, due to the configuration of the slots 76, 84 and the free portions 44, 54, the springs 40, 50 are engaged by and secured to the pivot brake assembly 60 without the use of any fasteners. As a result, assembly and disassembly of the balance assembly 10 can be accomplished significantly faster. Thus, manufacturing times of the window can be reduced since engagement of the free portions 44, 54 of the spring 40, 50 to the pivot brake assembly 60 involves only sliding the cooperatively dimensioned free portions 44, 54 into the appropriate slot 76, 84. This configuration also aids with disassembly, for example, during maintenance or repair. An individual need only slide the free portion 44, 54 of the spring 40, 50 out of the slot 76, 84 to disengage the springs 40, 50 from the pivot brake assembly 60. Furthermore, the balance assembly 10 of the present invention offers a number of cost savings. No apertures are required to be machined or otherwise formed in the free portions 44, 54 of the springs 40, 50. Additionally, no fasteners are required to secure the springs 40, 50 to the pivot brake assembly 60. Finally, because the free portion 44, 54 of the spring 40, 50 is free to travel across the width of the slot 76, 84 between the front wall 64 and rear wall 66 of the housing 62, the springs 40, 50 are easily adjustable. Whereas with the conventional spring balance assembly, precise location of the aperture in the spring is required to ensure proper alignment with the aperture in the housing, no such alignment concerns arise when using the balance assembly 10 of the present invention. Consequently, the balance assembly 10 of the present invention offers a multitude of cost-savings benefits as well as increased versatility, adjustability, and ease of assembly.

While the specific embodiments have been illustrated and described, numerous modifications come to mind without significantly departing from the spirit of the invention and the scope of protection is only limited by the scope of the accompanying claims.

I claim:

1. A balance assembly for a sash window slidable within a master frame, the balance assembly comprising:

a plate adapted to be attached to the master frame;

a first coil spring and a second coil spring wherein each spring has a coiled portion and a curvilinear free portion; and a shoe having a first slot and a second slot wherein each of the slots has a curved portion, each of the slots having a first end and a second end, wherein each slot is cooperatively dimensioned to receive a respective curvilinear free portion of the first or second coil spring, the shoe adapted to be attached to the sash window.

2. The balance assembly of claim 1, wherein the curved portion receives the free portion of either the first spring or the second spring.

3. The balance assembly of claim 1, wherein the curved portion receives an extent of the free portion of the first and second springs.

4. The balance assembly of claim 1 wherein the plate has two support members extending from the plate, each support member rotatably supporting one of the springs.

5. The balance assembly of claim 4 wherein each support member has a concave surface that rotatably engages the coiled portion of the spring.

6. The balance assembly of claim 4 wherein the plate includes at least one opening adapted to receive a fastener.

7. The balance assembly of claim 6 wherein the opening passes through the support member.

8. The balance assembly of claim 1, wherein each slot has a first end and a second end, and the curved portion of the slot is in communication with the first end.

9. The balance assembly of claim 8, wherein the curved portion receives an extent of the free portion of either the first spring or the second spring.

10. The balance assembly of claim 8, wherein the curved portion receives an extent of the free portion of the first and second springs.

11. A balance assembly for a sash window slidable within a master frame, the balance assembly comprising:

a coil spring, the spring having a coiled portion and a free portion, the coiled portion adapted to be attached to the master frame, the free portion having a curvilinear configuration; and, a shoe having at least one slot having a first curved end and a second end, the slot receiving and retaining the free portion of the spring, the shoe adapted to be attached to the sash window.

12. The balance assembly of claim 11 wherein the free portion of the spring is retained in the shoe without a fastener.

13. The balance assembly of claim 11 wherein the first curved end of the slot receives an extent of the free portion of the spring.

14. The balance assembly of claim 11 wherein the free portion of the spring defines a tab that is received by the first curved end of the slot.

15. The balance assembly of claim 11, wherein the slot defines a protrusion that engages the free portion of the spring in an assembled position.

16. The balance assembly of claim 11 wherein the shoe has a second slot whereby the free portion can be selectively received in one of the first slot and the second slot.

17. The balance assembly of claim 11 wherein the shoe has a brake to define a brake shoe assembly.

18. The balance assembly of claim 11 further comprising a plate adapted to be attached to the master frame in the channel, wherein the coiled portion of the spring is rotatably supported by the plate.

19. The balance assembly of claim 18 wherein the plate has a support member extending from the plate to rotatably support the spring.

20. The balance assembly of claim 19 wherein the support member has a concave surface that rotatably engages the coiled portion of the spring.

21. The balance assembly of claim 19 wherein the plate includes at least one opening adapted to receive a fastener.

22. The balance assembly of claim 21, wherein the opening passes through the support member.

23. A balance assembly for a sash window slidable within a master frame, the balance assembly comprising:

a first coil spring and a second coil spring wherein each spring has a coiled portion and a free portion, and wherein each free portion has an aperture;

a shoe having at least one curved slot wherein the slot is cooperatively dimensioned to receive the free portions of the first spring and the second spring, and wherein the shoe is adapted to be attached to the sash window; and, a fastener extending through the free portion apertures and an aperture in the shoe to secure the free portions in the curved slot.

* * * * *